US009829240B2

(12) United States Patent
Staedel et al.

(10) Patent No.: US 9,829,240 B2
(45) Date of Patent: Nov. 28, 2017

(54) DOMESTIC REFRIGERATION APPLIANCE WITH AN INNER CONTAINER AND A BASE

(71) Applicant: BSH BOSCH UND SIEMENS HAUSGERÄTE GMBH, Munich (DE)

(72) Inventors: Stefan August Staedel, Munich (DE); Zeki Asan, Corlu (TR); Alexander Görz, Aalen (DE); Cemalettin Hastürk, Cerkezkoy/Tekridag (TR)

(73) Assignee: BSH Hausgeräte GmbH, Munich (DE)

( * ) Notice: Subject to any disclaimer, the term of this patent is extended or adjusted under 35 U.S.C. 154(b) by 509 days.

(21) Appl. No.: 14/374,033

(22) PCT Filed: Jan. 9, 2013

(86) PCT No.: PCT/EP2013/050243
§ 371 (c)(1),
(2) Date: Jul. 23, 2014

(87) PCT Pub. No.: WO2013/110496
PCT Pub. Date: Aug. 1, 2013

(65) Prior Publication Data

US 2015/0013375 A1 Jan. 15, 2015

(30) Foreign Application Priority Data

Jan. 24, 2012 (DE) ..... 10 2012 201 023

(51) Int. Cl.
*F25D 23/02* (2006.01)
*F25D 23/00* (2006.01)
(Continued)

(52) U.S. Cl.
CPC ..... *F25D 23/028* (2013.01); *F25D 11/00* (2013.01); *F25D 23/003* (2013.01); *F25D 23/10* (2013.01);
(Continued)

(58) Field of Classification Search
CPC ... F25D 2323/00274; F25D 2317/0672; F25D 2323/00264; F25D 23/028; F25D 2317/067; F25D 2317/0671
See application file for complete search history.

(56) References Cited

U.S. PATENT DOCUMENTS 3,079,770 A * 3/1963 Brown ..... F25D 23/003 62/455
2004/0016256 A1* 1/2004 Chung ..... F25B 39/04 62/258
(Continued)

FOREIGN PATENT DOCUMENTS

CN 1627010 6/2005
CN 1654908 8/2005
(Continued)

OTHER PUBLICATIONS

International Search Report for PCT/EP2013/050243, dated Jun. 19, 2013.
(Continued)

*Primary Examiner* — Elizabeth Martin
*Assistant Examiner* — Zachary R Anderegg
(74) *Attorney, Agent, or Firm* — Nixon & Vanderhye, P.C.

(57) ABSTRACT

A domestic refrigeration device includes a heat-insulated inner container having an inner space; a refrigerant circuit provided for cooling the interior space; a door leaf for opening and closing the interior space; and a base on which the inner container is arranged and in which at least part of the refrigerant circuit is arranged. At least part of the front of said base is open to allow an exchange of air from the interior of the base with the surroundings of the domestic appliance. An air guiding element is mounted in front of the base and has a continuous front wall covering the front of the
(Continued)

base and is spaced apart from the floor on which the base stands. The air guiding element is open downwards in the direction of the floor.

23 Claims, 3 Drawing Sheets

(51) Int. Cl.
*F25D 11/00* (2006.01)
*F25D 23/10* (2006.01)

(52) U.S. Cl.
CPC ..... *F25D 2323/0021* (2013.01); *F25D 2323/00264* (2013.01); *F25D 2323/00274* (2013.01)

(56) References Cited

U.S. PATENT DOCUMENTS

2010/0244646 A1* 9/2010 Laible ..... E05D 11/0054 312/405
2011/0061416 A1* 3/2011 Rothmund ..... F25D 23/003 62/291

FOREIGN PATENT DOCUMENTS

| | | |
|---|---|---|
| CN | 1654909 | 8/2005 |
| CN | 1715815 | 1/2006 |
| DE | 299 449 | 5/1990 |
| DE | 195 28 826 | 2/1997 |
| EP | 0 190 794 | 8/1986 |
| EP | 1 384 962 A2 | 1/2004 |
| EP | 1 972 873 | 9/2008 |
| EP | 2 312 246 | 4/2011 |
| FR | 2647883 | 12/1990 |

OTHER PUBLICATIONS

Foreign-language Written Opinion of the International Searching Authority for PCT/EP2013/050243, dated Jun. 19, 2013.
Office Action issued in related European Patent Application No. 13 700 632.6-1605 dated Aug. 9, 2017, 6 pages.

* cited by examiner

DOMESTIC REFRIGERATION APPLIANCE WITH AN INNER CONTAINER AND A BASE

This application is a National Phase of International Application No. PCT/EP2013/050243, filed on Jan. 9, 2013, which designated the U.S. and claims priority to DE Application No. 10 2012 201 023.8, filed on Jan. 24, 2012, the entire contents of each of which are hereby incorporated by reference.

The invention relates to a domestic refrigeration appliance with an inner container and a base. The invention relates in particular to a floor-standing built-in domestic refrigeration appliance with a pivotable door leaf, the outer face of which is provided with a furniture unit front configured as a panel.

EP 1 972 873 A1 discloses a floor-standing built-in domestic refrigeration appliance, which has an inner container with a coolable interior space, a refrigerant circuit provided for cooling the interior space and a door leaf that is mounted in a pivotable manner for opening and closing the interior space. The compressor and condenser of the refrigerant circuit are arranged within a base of the built-in domestic refrigeration appliance, on which the inner container is arranged. Arranged on the front face of the base, in which a forced convection fan is arranged, are ventilation slits, which allow air convection between the interior of the base and the surroundings of the built-in domestic refrigeration appliance. The door leaf is provided with a panel configured as a furniture unit front on its outer face. The front face of the base is also provided with a panel, which is embodied in a similar manner to the furniture unit front of the door leaf and also has ventilation slits.

The object of the invention is to specify an improved domestic refrigeration appliance, which has an inner container with a coolable interior space and a base, on which the inner container is arranged and within which at least part of a refrigerant circuit for cooling the coolable interior space is arranged.

The object of the invention is achieved by a domestic refrigeration appliance, having a heat-insulated inner container with a coolable interior space, a refrigerant circuit provided for cooling the interior space, a door leaf provided for opening and closing the interior space and a base, on which the inner container is arranged and in which at least part of the refrigerant circuit is arranged, at least part of the front face of the base being open to allow an exchange of air from the interior of the base with the surroundings of the domestic refrigeration appliance and an air guiding apparatus being mounted in front of the base, having a continuous front wall mounted in front of the front face of the base and at a distance from the floor on which the base stands, the air guiding apparatus being open at the bottom in the direction of the floor. The inventive domestic refrigeration appliance is in particular a domestic refrigerator, a domestic freezer or a combined refrigerator/freezer. The door leaf is mounted in particular in a pivotable manner.

The inventive domestic refrigeration appliance therefore comprises the base, with which the domestic refrigeration appliance stands on the floor. Arranged on the base is the inner container with the coolable interior space. The inner container can also be enclosed by a housing. The inner container is heat-insulated and during correct operation of the domestic refrigeration appliance the coolable interior space is cooled by means of the refrigerant circuit. At least part of said refrigerant circuit, in particular the heat-producing parts of said refrigerant circuit, for example its compressor and condenser, is accommodated within the base. In order to allow an exchange of air with the surroundings of the domestic refrigeration appliance, at least part of the front face of the base is open. According to the invention the air guiding apparatus is mounted in front of the front face of the base, having a continuous front wall mounted in front of the front face of the base and at a distance from the floor on which the base stands. The front wall therefore has no openings. The air guiding apparatus is also open at the bottom in the direction of the base. It is therefore possible for the air to flow by way of the air guiding apparatus from the floor into the interior of the base. The air guiding apparatus is preferably curved from metal, in particular from a metal sheet. The metal sheet can be printed or painted for example before or afterwards. Aluminum or a stainless steel for example is also a suitable material for the air guiding apparatus.

The continuous front wall of the air guiding apparatus preferably extends to the height of the upper edge of the base. This for example prevents warm air from the interior of the base blowing directly forward. It is also possible for the front wall not to extend right to the upper edge of the base, in order for example to create space for a hinge for attaching the door leaf.

According to one embodiment of the inventive domestic refrigeration appliance the air guiding apparatus has two side walls, which extend from the front face of the base to the front wall, and/or an upper wall, which extends from the front face of the base to the front wall. This for example prevents warm air flowing out of the interior of the base at the side of the domestic refrigeration appliance. The side walls and/or the upper wall is/are preferably embodied as continuous side walls or as a continuous upper wall; in other words said walls preferably have no openings.

According to one embodiment of the inventive domestic refrigeration appliance the inner container and the door leaf project beyond the front face of the base. The door leaf can then in particular extend to the lower edge of the front wall of the air guiding apparatus, so that closed door leaf completely covers the front wall of the air guiding apparatus. The front wall of the air guiding apparatus prevents the warm air from the interior of the base flowing toward the face of the door leaf facing in the direction of the base, thereby reducing the thermal load of the door leaf. Instead the air guiding apparatus guides the heated air from the base through below the door leaf.

In order to configure the downward facing opening in the air guiding apparatus so that it is as large as possible, for example to achieve a better air exchange, according to a further variant of the inventive domestic refrigeration appliance the door leaf at least almost lies against the front wall of the air guiding apparatus in its closed position.

According to one preferred embodiment of the inventive domestic refrigeration appliance it has a furniture unit front configured as a panel, which is arranged on the outer face of the door leaf. The inventive domestic refrigeration appliance is then embodied as a floor-standing built-in domestic refrigeration appliance. The inner container, the door leaf and the furniture unit front in particular can project beyond the front face of the base.

According to a further variant of the inventive domestic refrigeration appliance the furniture unit front extends to the lower edge of the front wall of the air guiding apparatus so that, when the door leaf is closed, the furniture unit front completely covers the front wall of the air guiding apparatus. In contrast the door leaf preferably does not extend so far down. The front wall of the air guiding apparatus prevents the warm air from the interior of the base flowing toward the face of the furniture unit front facing in the direction of the base, thereby reducing the thermal load of the furniture unit front. Instead the air guiding apparatus guides the heated air from the base through below the furniture unit front.

In order to configure the downward facing opening in the air guiding apparatus so that it is as large as possible, for example to achieve a better air exchange, according to a further variant of the inventive domestic refrigeration appliance the furniture unit front at least almost lies against the front wall of the air guiding apparatus when the door leaf is closed.

To improve the exchange of air from the base with the surroundings of the inventive domestic refrigeration appliance, said domestic refrigeration appliance can have a fan arranged within the base, which is set up at least to assist the exchange of air from the interior of the base with the surroundings of the domestic refrigeration appliance by means of forced convection.

In order to guide the air from the surroundings of the inventive domestic refrigeration appliance more effectively into the interior of the base and the heated air back out of the interior of the base into the surroundings of the domestic refrigeration appliance, the air guiding apparatus can preferably have a vertical separating wall. This separating wall can be considered to be for example an extension of a separating wall within the base, which serves as an air guide within the base.

According to one embodiment of the inventive domestic refrigeration appliance the front wall has a recess, which is provided to receive a hinge, by means of which the door leaf is mounted in a pivotable manner.

To improve the appearance of the inventive domestic refrigeration appliance the front face of the base can be provided with a panel, which extends from the floor to the height of the lower edge of the front wall.

The air guiding apparatus can also have an opening, for example for a water filter.

An exemplary embodiment of the invention is shown by way of example in the accompanying schematic drawings, in which.

Figure 1:
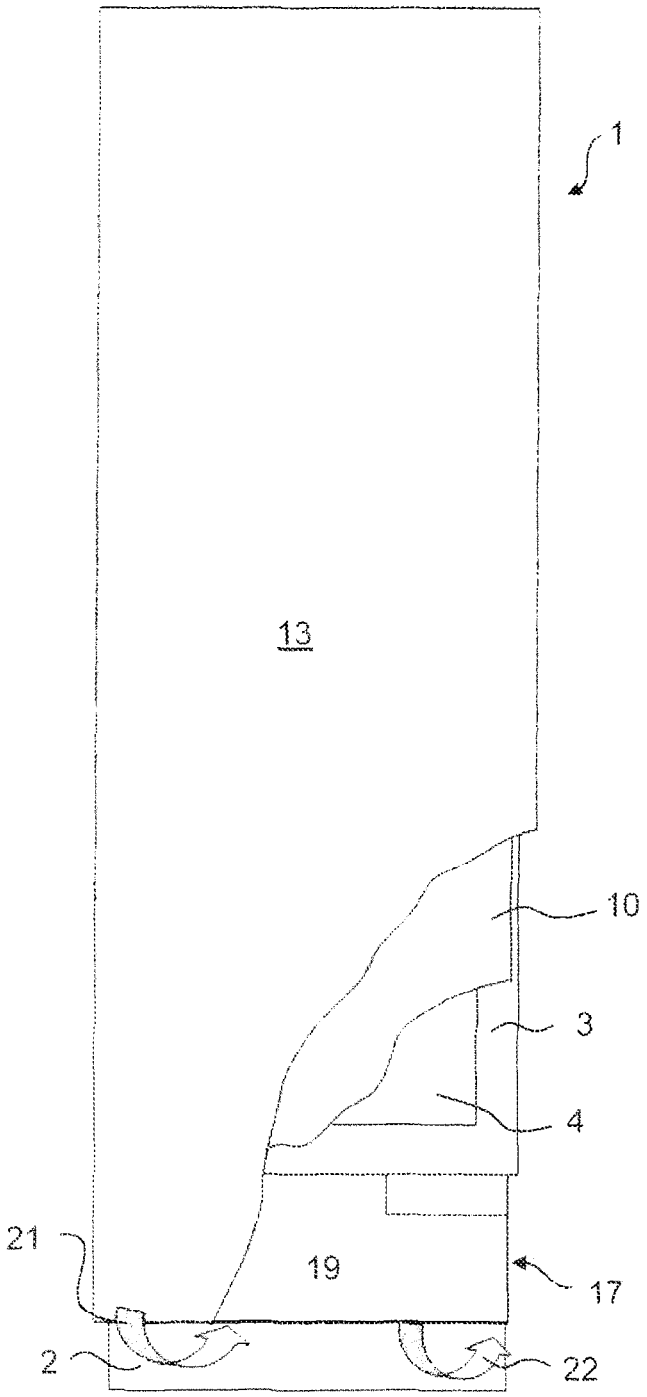
FIG. 1 shows a front view of a domestic refrigeration appliance.
Figure 2:
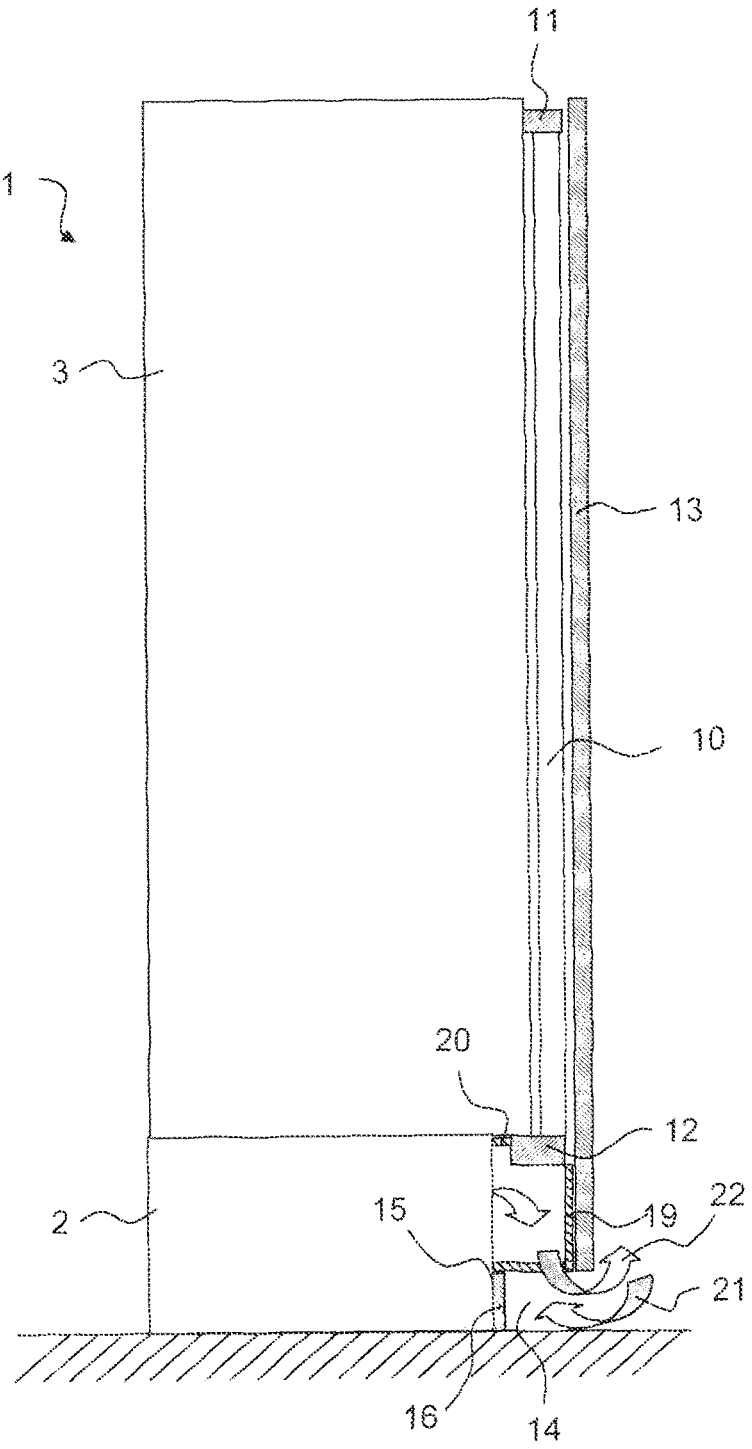
FIG. 2 shows a side view of the domestic refrigeration appliance.
Figure 3:
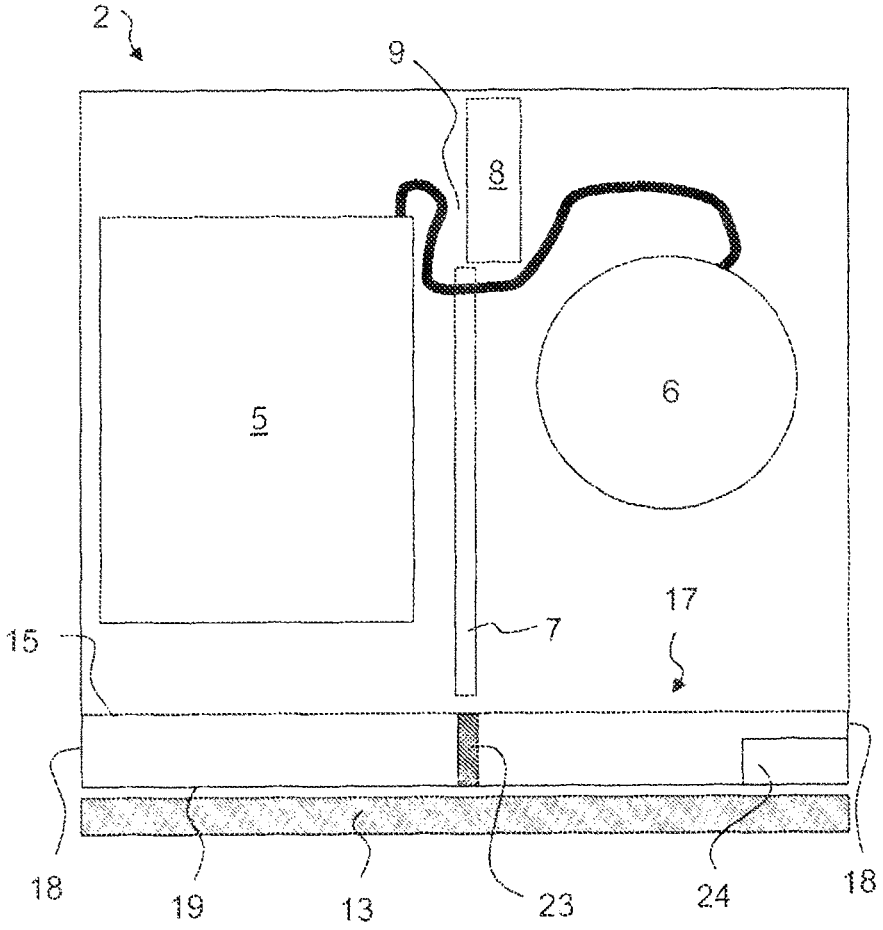
FIG. 3 shows a plan view of a base of the domestic refrigeration appliance.

FIG. 1 shows a front view of a domestic refrigeration appliance 1 and FIG. 2 shows a side view of the domestic refrigeration appliance 1. The domestic refrigeration appliance 1 is embodied for example as a domestic refrigerator or a domestic freezer. The domestic refrigeration appliance 1 is configured in particular as a so-called floor-standing built-in domestic refrigeration appliance, which has a base 2 and an inner container 3 with coolable interior space 4 arranged above the base 2. The domestic refrigeration appliance stands on the floor by means of the base 2, which can have feet for example. The inner container 3 can be enclosed by a housing. A plan view of the base 2 is shown in FIG. 3.

The domestic refrigeration appliance comprises at least one refrigerant circuit for cooling the coolable interior space 4. The refrigerant circuit, which is known in principle to the person skilled in the art, comprises a condenser 5, a compressor 6, a throttle apparatus (not shown in detail) and an evaporator (not shown in detail). The condenser 5 and the compressor 6, in other words the heat-producing parts of the refrigerant circuit, are arranged within the base 2. In particular the condenser 5 and the compressor 6 are arranged next to one another and separated from one another by a web 7 that runs from front to rear or a separating wall. In the present exemplary embodiment a fan 8 is also arranged within the base 2. Said fan 8 is arranged in particular in the rear region of the base 2 in the region of an opening 9 in the web 7 and is provided to achieve forced convection of the air from the condenser 5 through the opening 9 in the web 7 to the compressor 6.

The domestic refrigeration appliance 1 also has a control apparatus (not shown in detail), which is also arranged for example within the base 2 and is set up to activate the refrigerant circuit during operation of the domestic refrigeration appliance 1 in such a manner that the coolable interior space 4 is roughly at a predetermined or settable setpoint temperature, as known in principle to the person skilled in the art. The fan 8 can also be connected to the control apparatus so that it switches the fan 8 on and off as required for example for forced convection.

In the present exemplary embodiment the domestic refrigeration appliance 1 has a door leaf 10 for closing the coolable interior space 4. At least one door shelf for storing refrigerated goods can be arranged on the face of the door leaf 10 facing in the direction of the coolable interior space 4. The door leaf 10 is mounted in particular in a pivotable manner, for example by means of an upper hinge 11 and a lower hinge 12. The hinges 11, 12 can be embodied for example in such a manner that the door leaf 10 is mounted in relation to a vertically running axis. In the present exemplary embodiment the hinges 11, 12 are embodied as multi-articulated hinges so that during opening and closing the door leaf 10 executes a more complex rotational movement and does not just rotate about a rigid vertical axis. However the door leaf 11, 12 can also be attached in a different manner, for example by means of pull-out rails. The upper hinge 11 is attached to the inner container 3 for example. In the present exemplary embodiment the door leaf 10 extends to just below the upper edge of the base 2.

In the present exemplary embodiment a furniture unit front 13 configured as a panel is attached to the outer face of the door leaf 10. The furniture unit front 13 is in particular configured in such a manner that it covers the entire door leaf 10 when viewed from the front. In particular the furniture unit front 13 is at least as wide as the door leaf 10 and optionally projects beyond the door leaf 10 at the top. In its lower region the furniture unit front 13 continues below the door leaf 10. The furniture unit front 13 does not extend to the floor but forms a gap 14 of for example approx. 100 mm with this. The furniture unit front 13 therefore partially covers the base 2 when the door leaf 10 is in the closed state.

In the present exemplary embodiment the inner container 3 is deeper than the base 2 so that the inner container 3, the door leaf 10 and the furniture unit front 13 project beyond the front face 15 of the base 2. The front face 15 of the base 2 can also be provided with a panel 16, the appearance of which is matched in particular to the furniture unit front 13. The panel 16 on the front face 15 of the base 2 extends from the floor to the height at which the furniture unit front 13 starts.

In the present exemplary embodiment an air guiding apparatus 17 is attached to the front face 15 of the base 2. However the air guiding apparatus 17 can also be part of the base 2. The air guiding apparatus 17 extends in particular from the upper edge of the base 2 and ends above the floor at the height at which the furniture unit front 13 also ends in a downward direction. When the door leaf 10 is closed, the furniture unit front 13 therefore completely covers the air guiding apparatus 17.

The air guiding apparatus 17 is preferably made of metal, in particular a metal sheet, and is embodied in such a manner that it is open at the bottom. The air guiding apparatus 17 in particular comprises two continuous side walls 18, a continuous front wall 19 and a continuous upper wall 20. The upper wall 20 and the two side walls 18 are preferably extended forward so that they reach or almost reach the furniture unit front 13 when the door leaf 10 is closed. The front wall 19 in particular therefore at least almost lies against the furniture unit front 13 when the door leaf 10 is closed.

In the region of the air guiding apparatus 17 the front face 15 of the base 2 is open so that air flows from the surroundings of the domestic refrigeration appliance 1, in particular being forcibly conveyed by the fan 8, below the furniture unit front 13 through the air guiding apparatus 17, which is open at the bottom, in the direction of an arrow 21 into the air guiding apparatus 17 and then through the open front face 15 into the interior of the base 2. When operating, the fan 8 conveys the air flowing from the air guiding apparatus 17 first by way of the condenser 5 and/or past the condenser 5 through the opening 9 in the web 7, so that the air flows past the compressor 6 back through the open front face 15 of the base 2 and through the air guiding apparatus 17, which is open at the bottom, below the furniture unit front 13 now heated into the surroundings in the direction of an arrow 22. Because of the front wall 19 of the air guiding apparatus 17 the air does not flow past the inner face of the furniture unit front 13, with the result that this is exposed to a reduced thermal load.

To improve air guidance, the air guiding apparatus 2 can have an intermediate wall 23, which runs parallel to the side walls 18 of the air guiding apparatus 17 and roughly forms an extension of the web 7.

In the present exemplary embodiment the air guiding apparatus 17 has a recess 24 in its front wall 19, to hold the lower hinge 12 for attaching the door leaf 10.

If the domestic refrigeration appliance 1 does not have a furniture unit front 13, the door leaf 10 can also continue to the lower edge of the air guiding apparatus 17.

LIST OF REFERENCE CHARACTERS

1 Domestic refrigeration appliance
2 Base
3 Inner container
4 Coolable interior space
5 Condenser
6 Compressor
7 Web
8 Fan
9 Opening
10 Door leaf
11 Upper hinge
12 Lower hinge
13 Furniture unit front
14 Gap
15 Front face
16 Panel
17 Air guiding apparatus
18 Side walls
19 Front wall
20 Upper wall
21, 22 Arrow
23 Intermediate wall
24 Recess

The invention claimed is:

1. A domestic refrigeration appliance, having a heat-insulated inner container with a coolable interior space, a refrigerant circuit provided for cooling the interior space, a door leaf provided for opening and closing the interior space and a base, on which the inner container is arranged and in which at least part of the refrigerant circuit is arranged, at least part of a front face of the base being open to allow an exchange of air from an interior of the base with surroundings of the domestic refrigeration appliance, wherein an air guiding apparatus is mounted in front of the base, the air guiding apparatus having a continuous front wall mounted in front of the front face of the base and being spaced at a distance from a floor on which the base stands, the air guiding apparatus having a bottom portion defining a horizontal opening contained in a horizontal plane and a vertical air flow path, the continuous front wall separating an inner face of the door leaf from the vertical air flow path.

2. The domestic refrigeration appliance as claimed in claim 1, wherein the continuous front wall of the air guiding apparatus extends to a height of an upper edge of the base.

3. The domestic refrigeration appliance as claimed in claim 1, wherein the air guiding apparatus has two continuous side walls, which extend from the front face of the base to the front wall.

4. The domestic refrigeration appliance as claimed in claim 1, wherein the inner container and the door leaf project beyond the front face of the base, and wherein the closed door leaf completely covers the front wall of the air guiding apparatus.

5. The domestic refrigeration appliance as claimed in claim 1, further comprising a furniture unit front configured as a panel and arranged on an outer face of the door leaf, the inner container, the door leaf and the furniture unit front projecting beyond the front face of the base.

6. The domestic refrigeration appliance as claimed in claim 5, wherein the furniture unit front extends to a lower edge of the front wall of the air guiding apparatus so that, when the door leaf is closed, the furniture unit front completely covers the front wall of the air guiding apparatus and/or the furniture unit front at least almost lies against the front wall of the air guiding apparatus when the door leaf is closed.

7. The domestic refrigeration appliance as claimed in claim 1, further comprising a fan arranged within the base, which is set up at least to assist the exchange of air from the interior of the base with the surroundings of the domestic refrigeration appliance via forced convection.

8. The domestic refrigeration appliance as claimed in claim 1, wherein the air guiding apparatus has a vertical separating wall.

9. The domestic refrigeration appliance as claimed in claim 1, wherein the front wall has a recess, which is provided to receive a hinge, by means of which the door leaf is mounted in a pivotable manner.

10. The domestic refrigeration appliance as claimed in claim 1, wherein the front face of the base is provided with a panel, which extends from the floor to the height of a lower edge of the front wall, wherein the opening spans a horizontal distance between the front wall and the panel.

11. The domestic refrigeration appliance as claimed in claim 1, wherein the vertical air flow path is substantially vertically aligned with the door leaf.

12. The domestic refrigeration appliance as claimed in claim 1, wherein the vertical airflow path is positioned horizontally adjacent the continuous front wall.

13. The domestic refrigeration appliance as claimed in claim 1, wherein the base defines a gap beneath and vertically aligned with the opening, and the vertical air flow path is configured to direct air flow along the front wall and the gap.

14. The domestic refrigeration appliance as claimed in claim 1, wherein the front wall has no openings.

15. The domestic refrigeration appliance as claimed in claim 1, wherein a top end of the front wall is positioned below a bottom end of the door leaf.

16. The domestic refrigeration appliance as claimed in claim 1, wherein the front wall is stationary and is exposed when the door leaf is open, and covered by the door leaf when the door leaf is closed.

17. The domestic refrigeration appliance as claimed in claim 16, wherein the door leaf includes a furniture unit front that covers the front wall when the door leaf is closed.

18. A domestic refrigeration appliance, comprising:

a heat-insulated inner container with a coolable interior space;

a refrigerant circuit to cool the interior space;

a movable door leaf provided to open and close the interior space;

a base on which the inner container is arranged and in which at least part of the refrigerant circuit is arranged, at least part of a front face of the base being open to allow exchange of air from an interior of the base with surroundings of the domestic refrigeration appliance; and an air guiding apparatus mounted in front of or provided as part of the base, the air guide apparatus having a stationary continuous front wall with no openings and being spaced at a distance from a floor on which the base stands, the air guiding apparatus having a bottom portion defining a vertical flow path allowing the exchange of air in a substantially vertical direction through an opening contained in a horizontal plane, the stationary continuous front wall separating an inner face of the door leaf from the vertical air flow path.

19. The domestic refrigeration appliance as claimed in claim 18, further comprising a furniture unit front configured as a panel and arranged on an outer face of the door leaf, the inner container, the door leaf and the furniture unit front projecting beyond the front face of the base and wherein the furniture unit front extends to a lower edge of the front wall of the air guiding apparatus so that, when the door leaf is closed, the furniture unit front lies adjacent the front wall of the air guiding apparatus, the front wall being between the furniture unit front and the vertical flow path when the door leaf is closed.

20. The domestic refrigeration appliance as claimed in claim 18, wherein the vertical air flow path is substantially vertically aligned with the door leaf.

21. The domestic refrigeration appliance as claimed in claim 18, wherein the vertical airflow path is positioned horizontally adjacent the continuous front wall.

22. The domestic refrigeration appliance as claimed in claim 18, wherein the base defines a gap beneath and vertically aligned with the opening, and the vertical air flow path is configured to direct air flow along the front wall and the gap.

23. The domestic refrigeration appliance as claimed in claim 18, wherein the opening is open downwards in the direction of the floor on which the base is configured to rest.

* * * * *